US008494193B2

(12) United States Patent
Zhang et al.

(10) Patent No.: US 8,494,193 B2
(45) Date of Patent: Jul. 23, 2013

(54) ENVIRONMENT DETECTION AND ADAPTATION IN HEARING ASSISTANCE DEVICES

(75) Inventors: Tao Zhang, Eden Prairie, MN (US); Kaibao Nie, Bothwell, WA (US); Brent Edwards, San Francisco, CA (US); William S. Woods, Berkeley, CA (US); Jon S. Kindred, Minneapolis, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 902 days.

(21) Appl. No.: 11/276,793

(22) Filed: Mar. 14, 2006

(65) Prior Publication Data

US 2007/0219784 A1 Sep. 20, 2007

(51) Int. Cl.
*H04R 25/00* (2006.01)
*G10L 11/00* (2006.01)

(52) U.S. Cl.
USPC ..... 381/312; 704/200

(58) Field of Classification Search
USPC ..... 381/60, 312, 320, 321, 317, 318, 381/83, 93, 313, 92; 704/240, 200.1
See application file for complete search history.

(56) References Cited

U.S. PATENT DOCUMENTS

| | | | | |
|---|---|---|---|---|
| 5,604,812 | A | 2/1997 | Meyer | |
| 6,389,142 | B1 | 5/2002 | Hagen et al. | |
| 6,522,756 | B1 | 2/2003 | Maisano et al. | |
| 6,718,301 | B1 | 4/2004 | Woods | |
| 6,782,361 | B1 | 8/2004 | El-Maleh et al. | |
| 6,912,289 | B2 * | 6/2005 | Vonlanthen et al. | 381/312 |
| 7,149,320 | B2 | 12/2006 | Haykin et al. | |
| 7,158,931 | B2 | 1/2007 | Allegro | |
| 7,349,549 | B2 | 3/2008 | Bachler et al. | |
| 7,383,178 | B2 | 6/2008 | Visser et al. | |
| 7,454,331 | B2 | 11/2008 | Vinton et al. | |
| 7,986,790 | B2 | 7/2011 | Zhang et al. | |
| 8,068,627 | B2 | 11/2011 | Zhang et al. | |
| 8,143,620 | B1 | 3/2012 | Malinowski et al. | |

(Continued)

FOREIGN PATENT DOCUMENTS

| | | | |
|---|---|---|---|
| AU | 2005100274 | A4 | 6/2005 |
| AU | 2002224722 | B2 | 4/2008 |

(Continued)

OTHER PUBLICATIONS

U.S. Appl. No. 11/276,795, Non Final Office Action mailed May 7, 2009, 13 pgs.

(Continued)

*Primary Examiner* — Curtis Kuntz
*Assistant Examiner* — Sunita Joshi
(74) *Attorney, Agent, or Firm* — Schwegman, Lundberg & Woessner, P.A.

(57) ABSTRACT

Method and apparatus for environment detection and adaptation in hearing assistance devices. Performance of feature extraction and environment detection to perform adaptation to hearing assistance device operation for a number of hearing assistance environments. The system detecting various noise sources independent of speech. The system determining adaptive actions to take place based on predicted sound class. The system providing individually customizable response to inputs from different sound classes. In various embodiments, the system employing a Bayesian classifier to perform sound classifications using a priori probability data and training data for predetermined sound classes. Additional method and apparatus can be found in the specification and as provided by the attached claims and their equivalents.

32 Claims, 8 Drawing Sheets

U.S. PATENT DOCUMENTS

| | | | | |
|---|---|---|---|---|
| 2002/0012438 | A1 | 1/2002 | Leysieffer et al. | |
| 2002/0039426 | A1 | 4/2002 | Takemoto et al. | |
| 2002/0191799 | A1* | 12/2002 | Nordqvist et al. | 381/60 |
| 2002/0191804 | A1* | 12/2002 | Luo et al. | 381/312 |
| 2003/0112988 | A1 | 6/2003 | Naylor | |
| 2003/0144838 | A1 | 7/2003 | Allegro | |
| 2004/0015352 | A1* | 1/2004 | Ramakrishnan et al. | 704/240 |
| 2004/0190739 | A1 | 9/2004 | Bachler et al. | |
| 2005/0069162 | A1* | 3/2005 | Haykin et al. | 381/312 |
| 2005/0129262 | A1* | 6/2005 | Dillon et al. | 381/312 |
| 2007/0116308 | A1 | 5/2007 | Zurek et al. | |
| 2007/0117510 | A1 | 5/2007 | Elixmann | |
| 2007/0217620 | A1 | 9/2007 | Zhang et al. | |
| 2007/0217629 | A1 | 9/2007 | Zhang et al. | |
| 2007/0299671 | A1 | 12/2007 | McLachlan et al. | |
| 2008/0019547 | A1 | 1/2008 | Baechler | |
| 2008/0037798 | A1 | 2/2008 | Baechler et al. | |
| 2008/0107296 | A1 | 5/2008 | Bachler et al. | |
| 2012/0155664 | A1 | 6/2012 | Zhang et al. | |
| 2012/0213392 | A1 | 8/2012 | Zhang et al. | |

FOREIGN PATENT DOCUMENTS

| | | | |
|---|---|---|---|
| CA | 2439427 | | 4/2002 |
| EP | 0396831 | A2 | 11/1990 |
| EP | 0335542 | B1 | 12/1994 |
| EP | 1256258 | B1 | 3/2005 |
| WO | WO-0176321 | A1 | 10/2001 |
| WO | WO-0232208 | A2 | 4/2002 |

OTHER PUBLICATIONS

U.S. Appl. No. 11/276,795, Final Office Action mailed Oct. 14, 2009, 15 pgs.

U.S. Appl. No. 11/276,795, Response filed Sep. 8, 2009 to Non-Final Office Action mailed May 7, 2009, 10 pgs.

Preves, David A., "Field Trial Evaluations of a Switched Directional/Omnidirectional In-the-Ear Hearing Instrument", *Journal of the American Academy of Audiology*, 10(5), (May 1999),273-283.

U.S. Appl. No. 11/276,795, Advisory Action mailed Jan. 12, 2010, 13 pgs.

U.S. Appl. No. 11/276,795, Non-Final Office Action mailed May 27, 2010, 14 pgs.

U.S. Appl. No. 11/276,795, Pre-Appeal Brief Request mailed Feb. 16, 2010, 4 pgs.

U.S. Appl. No. 11/276,795, Response filed Dec. 14, 2009 to Final Office Action mailed Oct. 14, 2009, 10 pgs.

U.S. Appl. No. 11/276,795, Decision on Pre-Appeal Brief Request mailed Apr. 14, 2010, 2 pgs.

U.S. Appl. No. 11/276,795, Final Office Action mailed Nov. 24, 2010, 17 pgs.

U.S. Appl. No. 11/276,795, Response filed Sep. 28, 2010 to Non Final Office Action mailed May 27, 2010, 6 pgs.

El-Maleh, Khaled Helmi, "Classification-Based Techniques for Digital Coding of Speech-plus-Noise", Department of Electrical & Computer Engineering, McGill University, Montreal, Canada, A thesis submitted to McGill University in partial fulfillment of the requirements for the degree of Doctor of Philosophy., (Jan. 2004), 152 pgs.

U.S. Appl. No. 11/276,795, Examiner Interview Summary filed Mar. 11, 2011, 1 pg.

U.S. Appl. No. 11/276,795, Examiner Interview Summary mailed Feb. 9, 2011, 3 pgs.

U.S. Appl. No. 11/276,795, Notice of Allowance mailed Mar. 18, 2011, 12 pgs.

U.S. Appl. No. 11/276,795, Response filed Jan. 24, 2011 to Final Office Action mailed Nov. 24, 2010, 11 pgs.

European Application Serial No. 07250920.1, Extended European Search Report mailed May 11, 2007, 6 pgs.

U.S. Appl. No. 11/686,275, Notice of Allowance mailed Aug. 31, 2011, 9 pgs.

U.S. Appl. No. 11/686,275, Supplemental Notice of Allowability mailed Oct. 28, 2011, 3 pgs.

European Application Serial No. 07250920.1, Office Action mailed Sep. 27, 2011, 5 pgs.

European Application Serial No. 07250920.1, Office Action Response filed Feb. 1, 2012, 15 pgs.

U.S. Appl. No. 13/189,990, Non Final Office Action mailed Nov. 26, 2012, 12 pgs.

* cited by examiner 120
106
A/D
202
frequency analysis
203
210
Subband Signal Processing
212
time synthesis
140
D/A
205
204
Feature Extraction
206
Environment Detection
208
Environment Adaptation
Decimated Calculation Algorithm in Omni Aids Level-dependent Gain Reduction

ENVIRONMENT DETECTION AND ADAPTATION IN HEARING ASSISTANCE DEVICES

TECHNICAL FIELD

This disclosure relates to hearing assistance devices, and more particularly to method and apparatus for environment detection and adaptation in hearing assistance devices.

BACKGROUND

Many people use hearing assistance devices to improve their day-to-day listening experience. Persons who are hard of hearing have many options for hearing assistance devices. One such device is a hearing aid. Hearing aids may be worn on-the-ear, behind-the-ear, in-the-ear, and completely in-the-canal. Hearing aids can help restore hearing, but they can also amplify unwanted sound which is bothersome and sometimes ineffective for the wearer.

Many attempts have been made to provide different hearing modes for hearing assistance devices. For example, some devices can be switched between directional and omnidirectional receiving modes. However, different users typically have different exposures to sound environments, so that even if one hearing aid is intended to work substantially the same from person-to-person, the user's sound environment may dictate uniquely different settings.

However, even devices which are programmed for a person's individual use can leave the user without a reliable improvement of hearing. For example, conditions can change and the device will be programmed for a completely different environment than the one the user is exposed to. Or conditions can change without the user obtaining a change of settings which would improve hearing substantially.

What is needed in the art is an improved system for updating hearing assistance device settings to improve the quality of sound received by those devices. The system should be highly programmable to allow a user to have a device tailored to meet the user's needs and to accommodate the user's lifestyle. The system should provide intelligent and automatic switching based on detected environments and programmed settings and should provide reliable performance for changing conditions.

SUMMARY

The above-mentioned problems and others not expressly discussed herein are addressed by the present subject matter and will be understood by reading and studying this specification. The present subject matter provides method and apparatus for environment detection and adaptation in hearing assistance devices. Various examples are provided to demonstrate aspects of the present subject matter. One example of an apparatus employing the present subject matter includes: a microphone; an analog-to-digital (A/D) converter connected to convert analog sound signals received by the microphone into time domain digital data; a processor connected to process the time domain digital data and to produce time domain digital output, the processor including: a frequency analysis module to convert the time domain digital data into subband digital data; a feature extraction module to determine features of the subband data; an environment detection module to determine one or more sources of the subband data based on a plurality of possible sources identified by predetermined classification parameters; an environment adaptation module to provide adaptations to processing using the determination of the one or more sources of the subband data; a subband signal processing module to process the subband data using the adaptations from the environment adaptation module; and a time synthesis module to convert processed subband data into the time domain digital output. Variations include, but are not limited to, the previous example plus combinations including one or more of: a digital-to-analog (D/A) converter connected to receive the time domain digital output and convert it to analog signals; a receiver to convert the analog signals to sound; examples where the environment detection module is adapted to determine sources including wind, machine noise, and speech; where the speech source includes a first speech source associated with a user of the apparatus and a second speech source; where the environment adaptation module includes parameter storage for each of the plurality of possible sources, the parameter storage including a plurality of subband gain parameter storages; where the parameter storage further includes an attack parameter storage and a release parameter storage; where the parameter storage further includes a misclassification threshold parameter storage; where the environment detection module includes a Bayesian classifier; where the environment detection module includes storage for one or more a priori probability variables; where the environment detection module comprises storage for training data; a second microphone; further including a second A/D converter connected to convert analog sound signals received by the second microphone into additional time domain digital data, the additional time domain digital data combined with the time domain digital data provided to the processor for processing; and where the processor further includes a directivity module.

Some other variations include: a microphone; an analog-to-digital (A/D) converter connected to convert analog sound signals received by the microphone into time domain digital data; a processor connected to process the time domain digital data and to produce time domain digital output, the processor including: a frequency analysis module to convert the time domain digital data into subband digital data; feature extraction means for extracting features of the subband data; environment detection means for determining one or more sources of the subband data based on a plurality of possible sources identified by predetermined classification parameters; environment adaptation means for providing adaptations to processing using the determination of the one or more sources of the subband data; and subband signal processing means for processing the subband data using the adaptations from the environment adaptation module. Some examples include a second microphone and second A/D converter and directivity means for adjusting receiving microphone configuration.

The present subject matter also includes variations of methods. For example a method, including: converting one or more time domain analog acoustic signals into frequency domain subband samples; extracting features from the subband samples using time domain analog signal information; detecting environmental parameters to categorize one or more sound sources based on a predetermined plurality of possible sound sources; and adapting processing of the subband samples using the one or more categorized sound sources. Further examples include the previous and combinations including one or more of: where the detecting includes using a Bayesian classifier to categorize the one or more sound sources; where the predetermined plurality of possible sound sources comprises: wind, machines, and speech; and including discriminating speech associated with a user of an apparatus performing the method from speech of other speakers; and including applying parameters associated with the one or more categorized sound sources, the parameters including a gain adjustment, an attack parameter, a release parameter, and a misclassification threshold parameter; where the gain adjustment is stored as individual gain settings per subband; including adjusting directionality using detected environmental parameters; and including processing the subband samples using hearing aid algorithms.

This Summary is an overview of some of the teachings of the present application and not intended to be an exclusive or exhaustive treatment of the present subject matter. Further details about the present subject matter are found in the detailed description and appended claims. Other aspects will be apparent to persons skilled in the art upon reading and understanding the following detailed description and viewing the drawings that form a part thereof, each of which are not to be taken in a limiting sense. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present subject matter relates to methods and apparatus for environment detection and adaptation in hearing assistance devices.

The method and apparatus set forth herein are demonstrative of the principles of the invention, and it is understood that other method and apparatus are possible using the principles described herein.

System Overview

Figure 1:
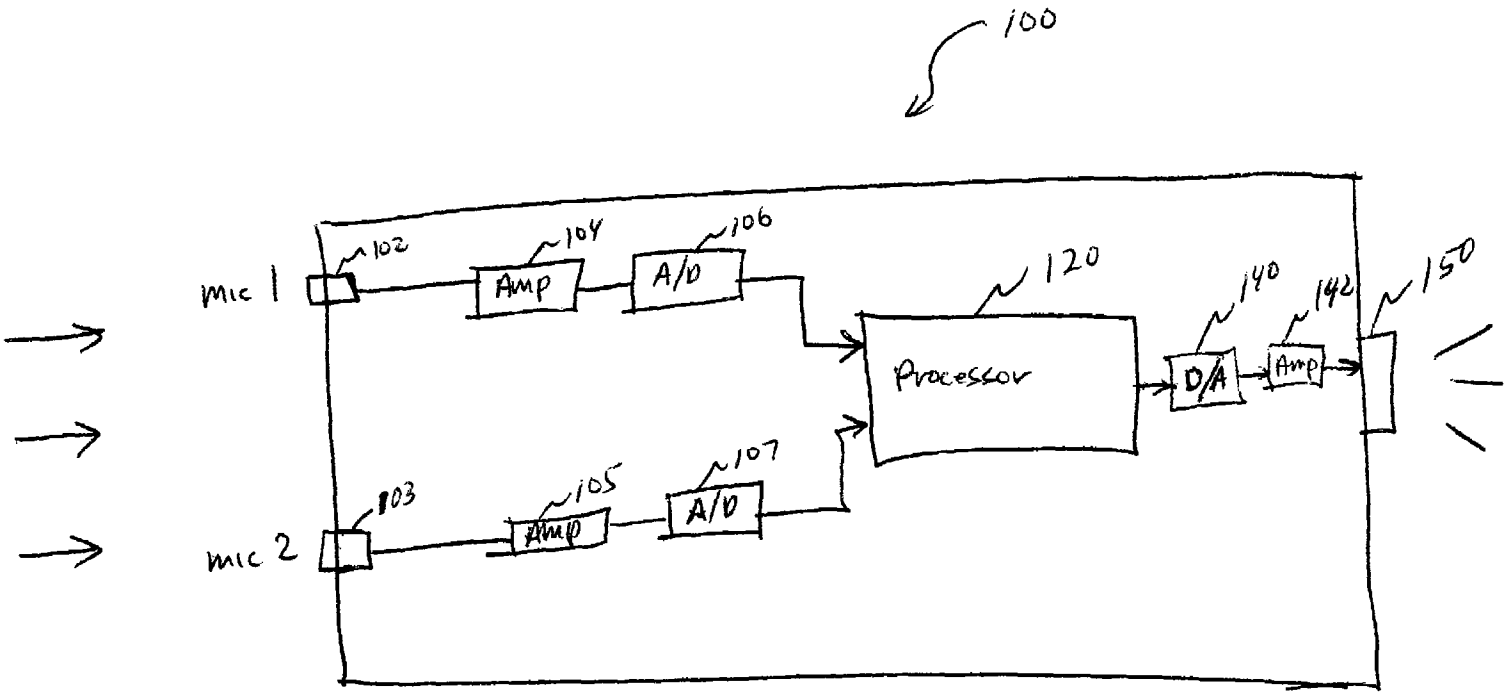
FIG. 1 shows a block diagram of a hearing assistance device, according to one embodiment of the present subject matter.

FIG. 1 shows a block diagram of a hearing assistance device, according to one embodiment of the present subject matter. In one embodiment, hearing assistance device 100 is a hearing aid. In one embodiment, mic 1 102 is an omnidirectional microphone connected to amplifier 104 which provides signals to analog-to-digital converter 106 ("A/D converter"). The sampled signals are sent to processor 120 which processes the digital samples and provides them to the digital-to-analog converter 140 ("D/A converter"). Once the signals are analog, they can be amplified by amplifier 142 and audio sound can be played by receiver 150 (also known as a speaker). Although FIG. 1 shows D/A converter 140 and amplifier 142 and receiver 150, it is understood that other outputs of the digital information may be performed. For instance, in one embodiment, the digital data is sent to another device configured to receive it. For example, the data may be sent as streaming packets to another device which is compatible with packetized communications. In one embodiment, the digital output is transmitted via digital radio transmissions. In one embodiment, the digital radio transmissions are packetized and adapted to be compatible with a standard. Thus, the present subject matter is demonstrated, but not intended to be limited, by the arrangement of FIG. 1.

In one embodiment, mic 2 103 is a directional microphone connected to amplifier 105 which provides signals to analog-to-digital converter 107 ("A/D converter"). The samples from A/D converter 107 are received by processor 120 for processing. In one embodiment, mic 2 103 is another omnidirectional microphone. In such embodiments, directionality is controllable via phasing mic 1 and mic 2. In one embodiment, mic 1 is a directional microphone with an omnidirectional setting. In one embodiment, the gain on mic 2 is reduced so that the system 100 is effectively a single microphone system. In one embodiment, (not shown) system 100 only has one microphone. Other variations are possible which are within the principles set forth herein.

Processor 120 includes modules for execution that will detect environments and make adaptations accordingly as set forth herein. Such processing can be on one or more audio inputs, depending on the function. Thus, even though, FIG. 1 shows two microphones, it is understood that many of the teachings herein can be performed with audio from a single microphone. It is also understood that audio transducers other than microphones can be used in some embodiments.

Figure 2:
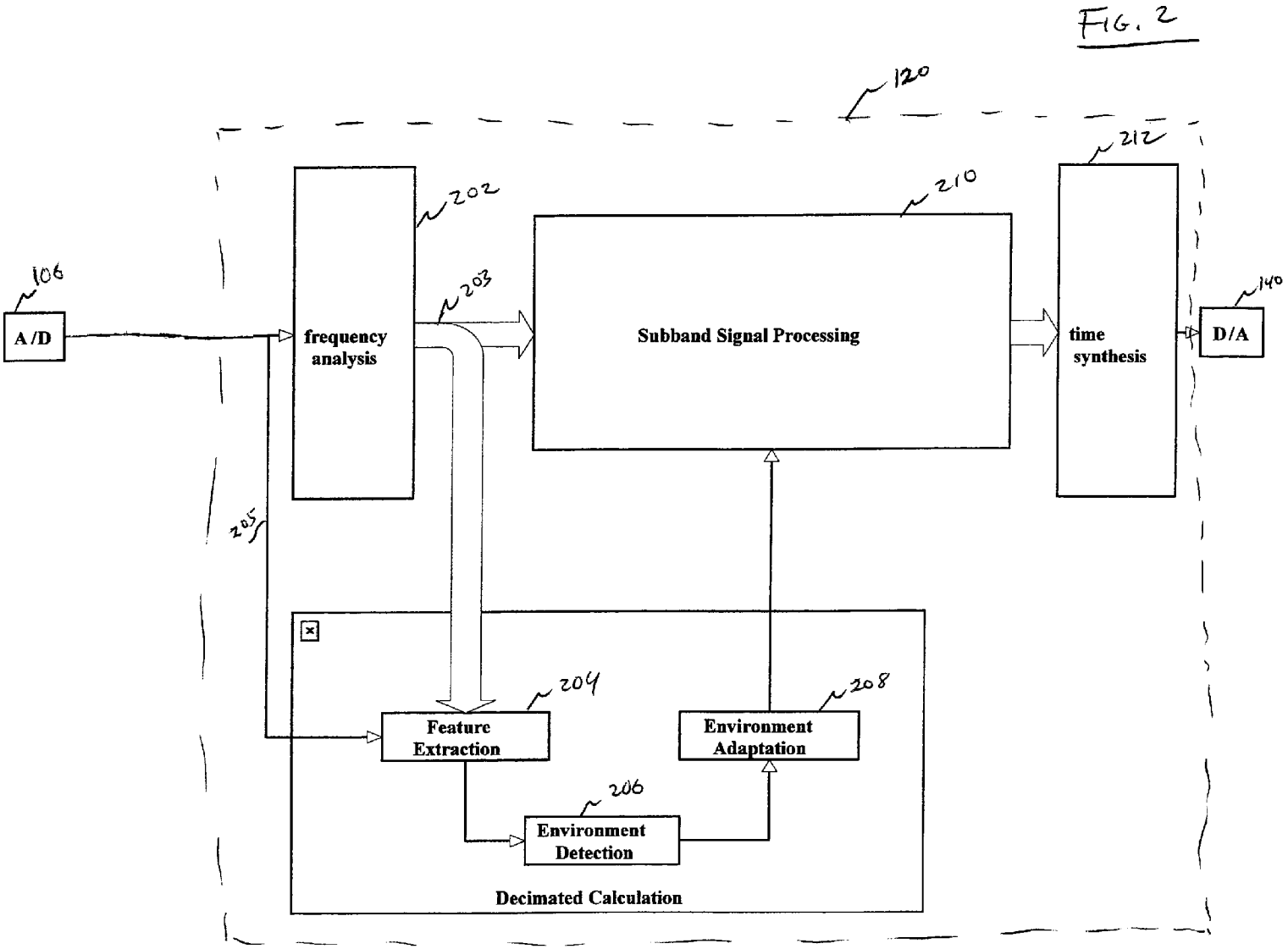
FIG. 2 shows a process diagram of environment detection and adaptation, according to one embodiment of the present subject matter.

FIG. 2 shows a process diagram of environment detection and adaptation, according to one embodiment of the present subject matter. FIG. 2 shows one example of processes performed by processor 120. Signals from A/D converter 106 are received by processor 120 for conversion from time domain into frequency domain information via frequency analysis module 202. It is noted that some of the details of conversion from time domain signals (such as from microphone 430) to frequency domain signals, and vice-versa, were omitted from the figures to simplify the figures. Several known approaches exist to digitize the data and convert it into frequency domain samples. For example, in various embodiments overlap-add structures (not shown) are available to assist in conversion to the frequency domain and, from frequency domain back into time domain. Some such structures are shown, for example, in *Adaptive Filter Theory* ($4^{th}$ Edition) by Simon Haykin, Prentice Hall, 2001, and, section 7.2.5 of *Multirate Digital Signal Processing*, by Crochiere and Rabiner, Prentice Hall, 1983. Other time domain to frequency domain conversions are possible without departing from the scope of the present subject matter. The sampled frequency domain information is divided into frequency subbands for processing.

Feature extraction module 204 receives both frequency domain or subband samples 203 and time domain samples 205 to determine features of the incoming samples. The feature extraction module generates information based on its inputs, including, but not limited to: periodicity strength, high-to-low-frequency energy ratio, spectral slopes in various frequency regions, average spectral slope, overall spectral slope, spectral shape-related features, spectral centroid, omni signal power, directional signal power, and energy at a fundamental frequency. This information is used by the environment detection module 206 to determine what a probable source is from a predetermined number of possible sources. The environment adaptation module then adjusts signal processing based on the probable source of the sound, sending parameters for use in the subband signal processing module 210. The subband signal processing module 210 is used to adaptively process the subband data using both the adaptations due to environment and any other applications-specific signal processing tasks. For example, when the present system is used in a hearing aid, the subband signal processing module 210 also performs hearing aid processing associated with enhancing hearing of a particular wearer of the device.

Time synthesis module 212 converts the processed subband samples into time domain digital output which is sent to D/A converter 140 for conversion into analog signals. The references cited above pertaining to frequency synthesis also provide information for the conversion of subband samples into time domain. Other frequency domain to time domain conversions are possible without departing from the scope of the present subject matter. It is understood that the system set forth is an example, and that variations of the system are possible without departing from the scope of the present subject matter.

Environment Detection

Figure 3:
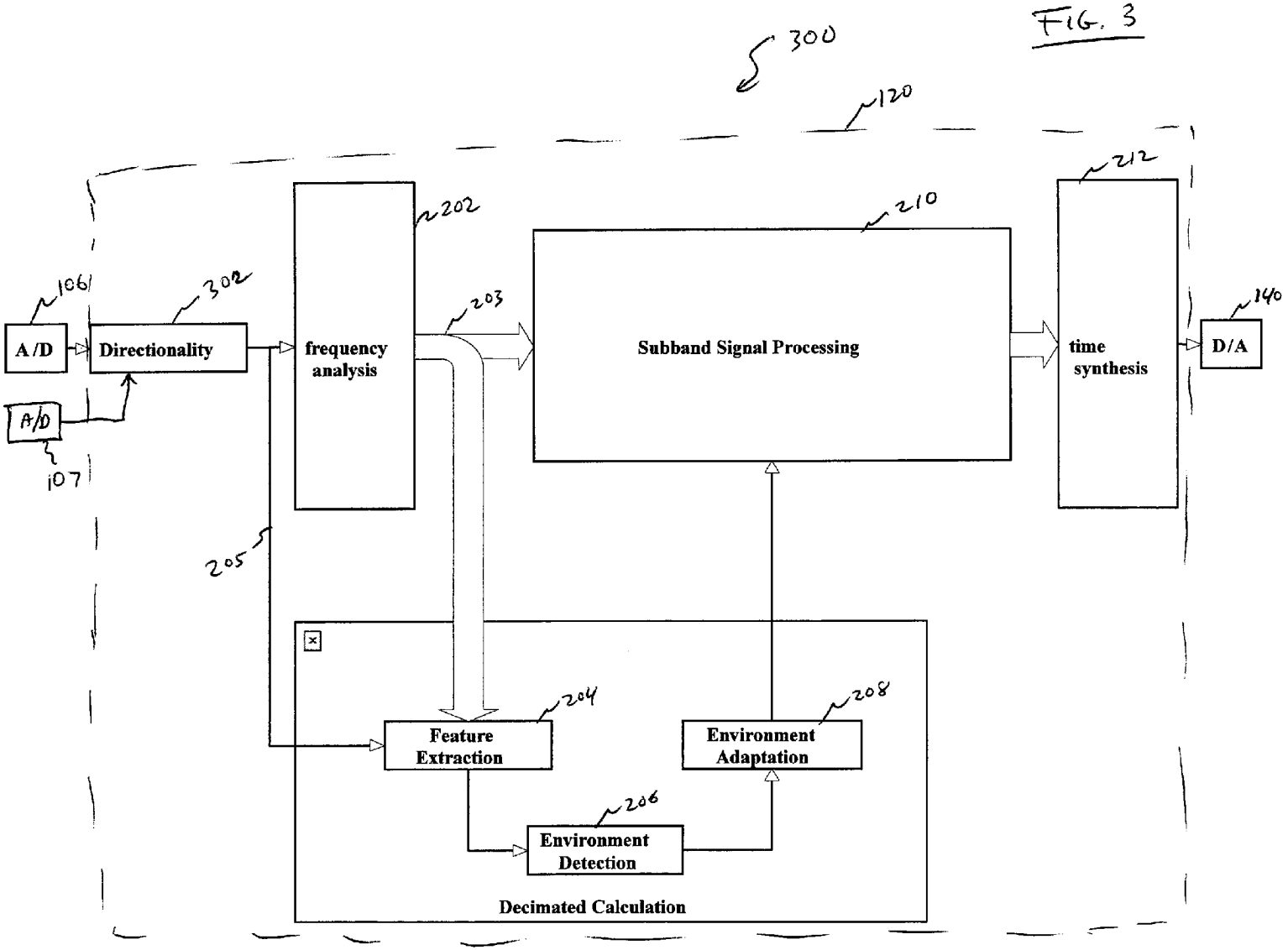
FIG. 3 shows a process diagram of directionality combined with environment detection and adaptation, according to one embodiment of the present subject matter.

FIG. 3 shows a process diagram of directionality combined with environment detection and adaptation, according to one embodiment of the present subject matter. The directionality feature is described in detail in U.S. Provisional Patent Application Ser. No. 60/743,481, filed even date herewith, and commonly assigned, the entire disclosure of which is incorporated herein by reference. The system 300 has processor 120 is able to receive digital samples from a plurality of various sources. For demonstration, A/D converters 106 and 107 are shown to provide digital samples to processor 120. The digital samples from mic 1 and mic 2 are processed by the directionality module, which can select favorable microphone configurations based on preprogrammed parameters for reception as set forth in the application incorporated by reference above. The directionality module 302 transmits time domain samples to the rest of the system which operates substantially as set forth above for FIG. 2. In some embodiments, information from the directionality module 302, such as mode information and other information, is shared with other modules of the system 300. Other variations exist which do not depart from the principles provided herein.

Figure 4:
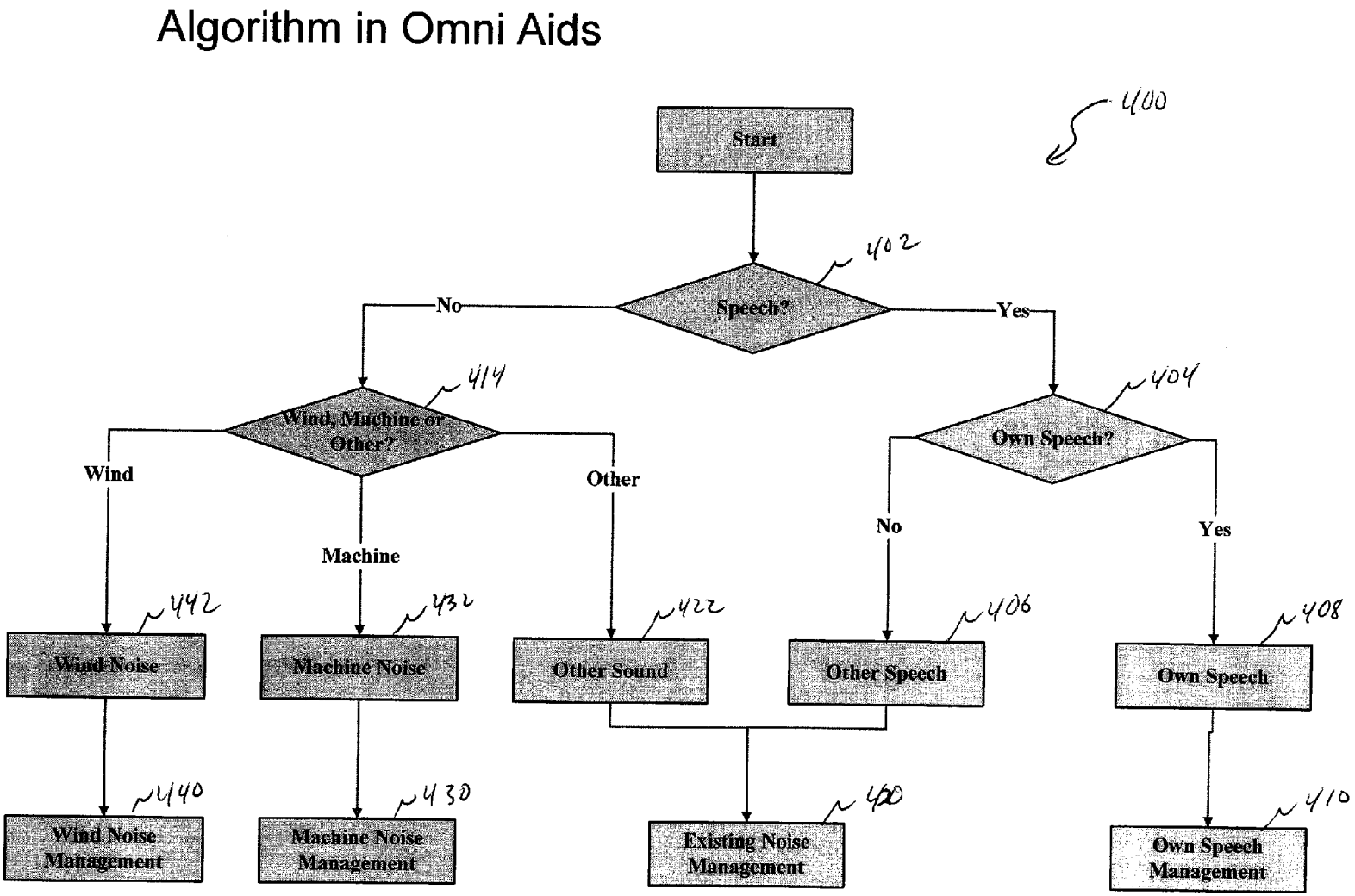
FIG. 4 shows a process for classification of sound sources for reception in an omnidirectional hearing assistance device, according to one embodiment of the present subject matter.

FIG. 4 shows a process for classification of sound sources for reception in an omnidirectional hearing assistance device, according to one embodiment of the present subject matter. The process 400 first determines if speech is detected 402. (Examples of speech detection are provided in conjunction with the discussion of FIG. 6.) If so, the system then detects whether a wearer of the device is speaking 404, 408 and if so then manages that sound according to parameters set for "own speech" 410. Such parameters may include attenuation of own speech or other signal processing tasks. If the speech is not detected from the wearer, then it is deemed "other speech" 406 and that sound is managed as if it were regular noise 420.

If speech is not detected 402, the process then determines whether the sound is wind, machine or other sound 414. If wind noise 442, then special parameters for wind noise management are used 440. If machine noise 432, then special parameters for machine noise management are used 430. If other sound 422, then the sound is managed as if it were regular noise 420.

The process set forth here are intended to demonstrate principles of the present subject matter and are not intended to be an exhaustive or exclusive treatment of the possible embodiments. Other embodiments featuring variations of these features are possible without departing from the scope of the present subject matter.

Figure 5:
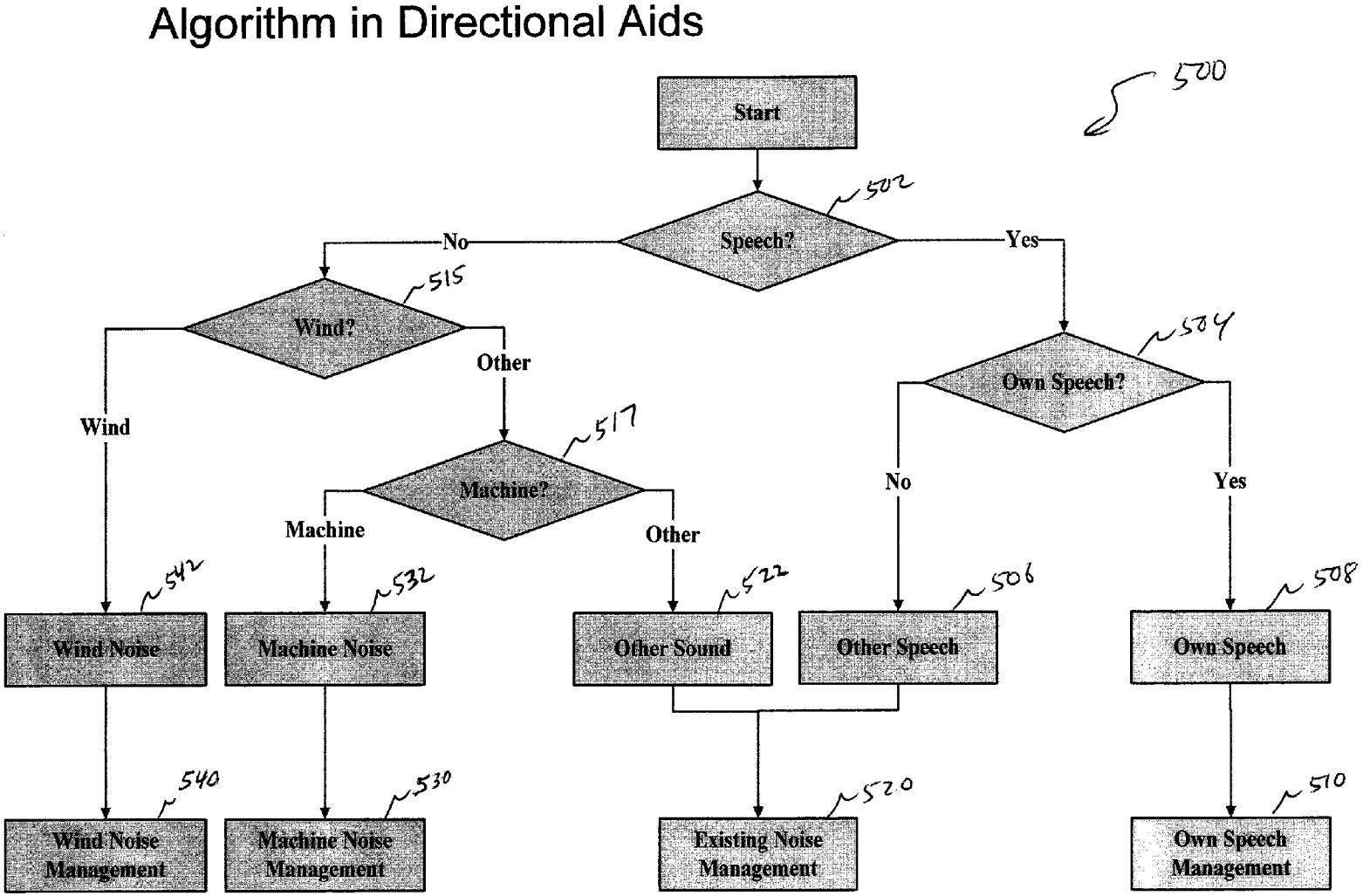
FIG. 5 shows a process for classification of sound sources for reception in a directional hearing assistance device, according to one embodiment of the present subject matter.

FIG. 5 shows a process for classification of sound sources for directional reception in a hearing assistance device, according to one embodiment of the present subject matter. The process 500 first determines if speech is detected 502. If so, the system then detects whether a wearer of the device is speaking 504, 508 and if so then manages that sound according to parameters set for "own speech" 510. Such parameters may include attenuation of own speech or other signal processing tasks. If the speech is not detected from the wearer, then it is deemed "other speech" 506 and that sound is managed as if it were regular noise 520.

If speech is not detected 502, the process then determines whether the sound is wind noise 515. If wind noise 542, then special parameters for wind noise management are used 540. If not wind noise, then the process detects for machine noise 517. If machine noise 532, then special parameters for machine noise management are used 530. If other sound 522, then the sound is managed as if it were regular noise 520.

The process set forth here are intended to demonstrate principles of the present subject matter and are not intended to be an exhaustive or exclusive treatment of the possible embodiments. Other embodiments featuring variations of these features are possible without departing from the scope of the present subject matter.

Figure 6:
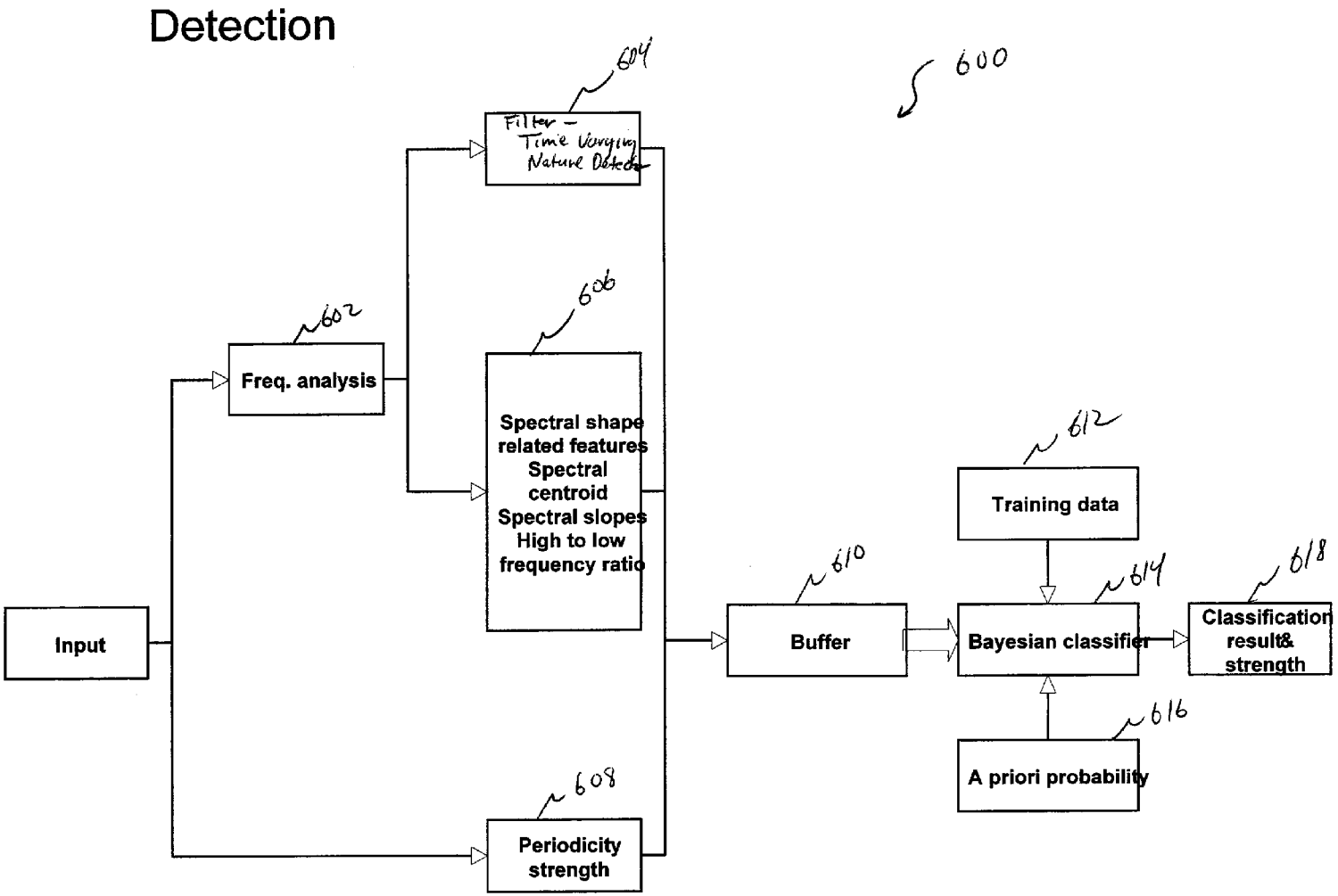
FIG. 6 shows a flow diagram of a detection system, according to one embodiment of the present subject matter.

FIG. 6 shows a flow diagram of a detection system, according to one embodiment of the present subject matter. In one embodiment, frequency domain samples from the source input are converted into the frequency domain by frequency analysis module 602. The resulting subband samples are processed by filter 604 to determine the time-varying nature of the samples. In one embodiment, the metric is related to a ratio of a time dependent mean (M) of the input over the time-dependent deviation of the input from the mean (D) or MID as provided by U.S. Pat. No. 6,718,301 to William S. Woods, the entire disclosure of which is incorporated herein by reference. Filter 606 also processes the samples to determine, among other things, spectral shape related features such as spectral centroid, spectral slopes, and high v. low frequency ratio. Block 608 measures the periodicity strength of the time domain input samples. The resulting data is sent to buffer 610 and then processed by a Bayesian classifier 614. The Bayesian classifier is used because it is computationally efficient. The Bayesian classifier 614 incorporates inputs from stored and preprogrammed a priori probability parameters 616 that the detected sounds are likely to be one of the predetermined sources (e.g., wind, machinery, own speech, other speech, other noise). The goal of the Bayesian classification scheme is to choose the sound class that is most likely to occur given the feature values 610, training data 612 and the a priori probabilities 616, or probability that a sound class (e.g., wind, machinery, own speech, other speech, other noise) occurs in the real world. By changing the a priori probabilities, it is possible to increase/decrease the accuracy of the selection of sound class arising from the same sound class ("hit rate") and increase/decrease the misclassifications of a sound class into a different sound class ("false alarm rate"). The resulting classification result and strength data is produced and stored 618 to be used to adapt processing for the particular environment detected. Classification result is the resulting classification. Classification strength is the relative likelihood that a sound class is statistically detected. Thus, system 600 could be used to perform the feature extraction module 204 and environment detection module 206 of FIGS. 2 and 3. Other systems may be employed without departing from the scope of the present subject matter.

In one embodiment a linear Bayesian classifier was chosen as Bayesian classifier 614. Given a set of feature values for the input sound, the a priori probability of each sound class, and training data, the Bayesian classifier chooses the sound class with the highest probability ("posteriori probability") as the classification result. The Bayesian classifier also produces a classification strength result.

In various embodiments, different features may be used to determine sound classifications. Some features that demonstrate the principles herein are found in one embodiment as follows:

Speech Detection Features a. Periodicity strength
b. High-to-low-frequency energy ratio
c. Low frequency spectral slope
d. M/D at 0-750 Hz
e. M/D at 4000-7750 Hz Wind and Machine Noise Detection Features For Omni Hearing Assistance Devices a. Periodicity strength
b. High-to-low-frequency energy ratio
c. Low frequency spectral slope
d. M/D at 750-1750 Hz
e. M/D at 4000-7750 Hz Machine Noise Detection Features for Directional Hearing Assistance Devices a. Periodicity strength in logarithmic scale
b. High-to-low-frequency energy ratio
c. Low frequency spectral slope
d. M/D at 0-750 Hz
e. M/D at 4000-7750 Hz Own Speech Detection a. High-to-low frequency energy ratio
b. Energy at the fundamental frequency
c. Average spectral slope
d. Overall spectral slope Wind Noise Detection for Directional Hearing Assistance Devices a. Omni signal power (unfiltered)
b. Directional signal power (unfiltered)
c. Detection Rules (Hysteresis Example)
i. Wind noise is not detected if omni signal power is greater than an upper threshold ($T_u$) plus directional signal power
ii. Wind noise is detected if omni signal power is less than a lower threshold ($T_l$) plus directional signal power
iii. Otherwise, wind noise detection status is unchanged The Wind Noise Detection for Directional Hearing Assistance Devices in various embodiments can provide hysteresis to avoid undue switching between detections. In various embodiments, the upper threshold ($T_u$) and lower threshold ($T_l$) are determined empirically. In various embodiments each microphone can be fed into a signal conditioning circuit which acts as a long term averager of the incoming signal. For example, a one-pole filter can be implemented digitally to perform measurement of power from a microphone by averaging a block of 8 samples from the microphone for wind noise detection.

It is understood that departures from the foregoing embodiments are contemplated and that other features and variables and variable ranges may be employed using the principles set forth herein.

Environment Adaptation

Figure 7:
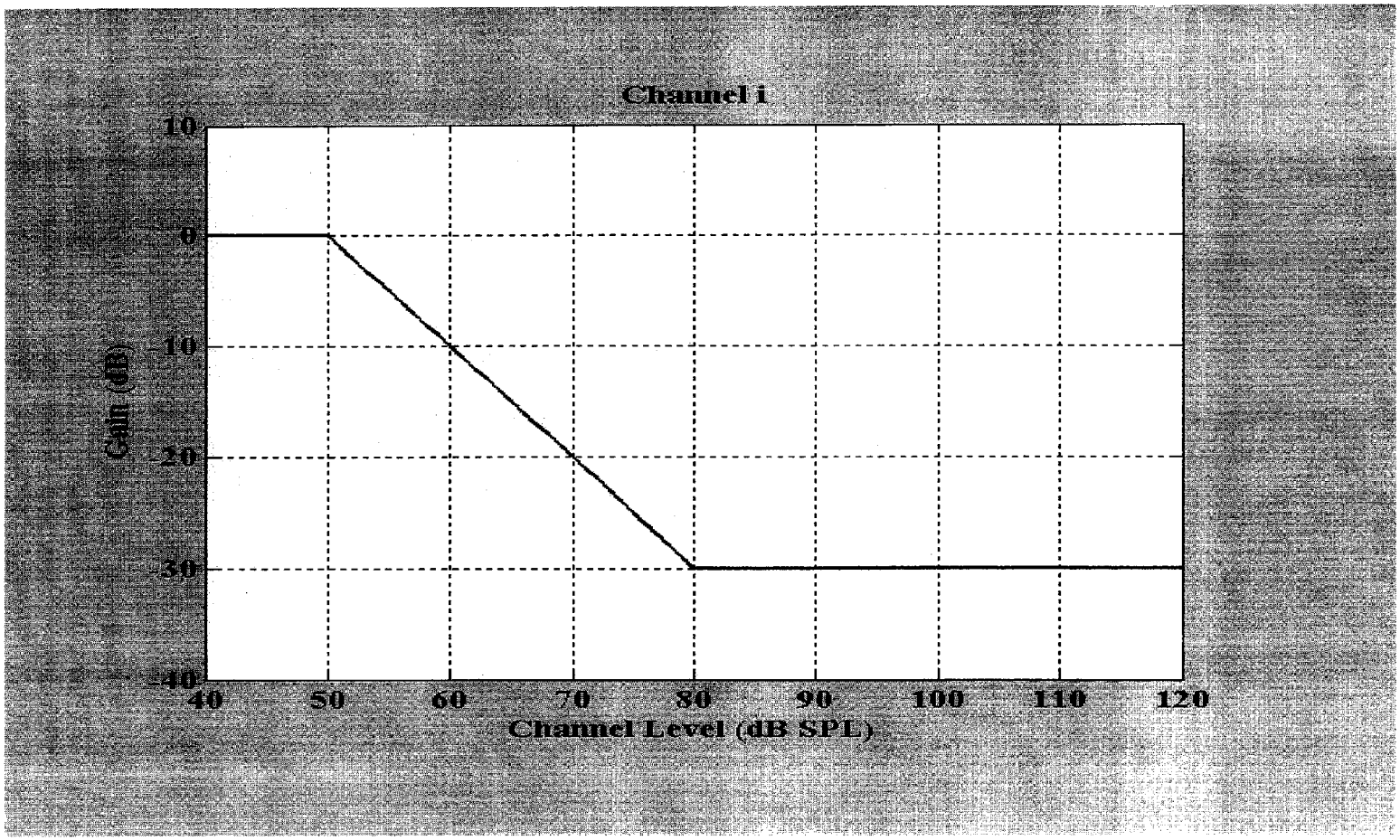
FIG. 7 shows a gain diagram of a gain reduction process, according to one embodiment of the present subject matter.

In various embodiments, the system employs gain adjustments that raise gain if the incoming sound level is too low and lower gain if the incoming sound level is too high. FIG. 7 shows a gain diagram of a gain reduction process, according to one embodiment of the present subject matter. Other gain control techniques are possible without departing from the scope of the present subject matter.

Figure 8:
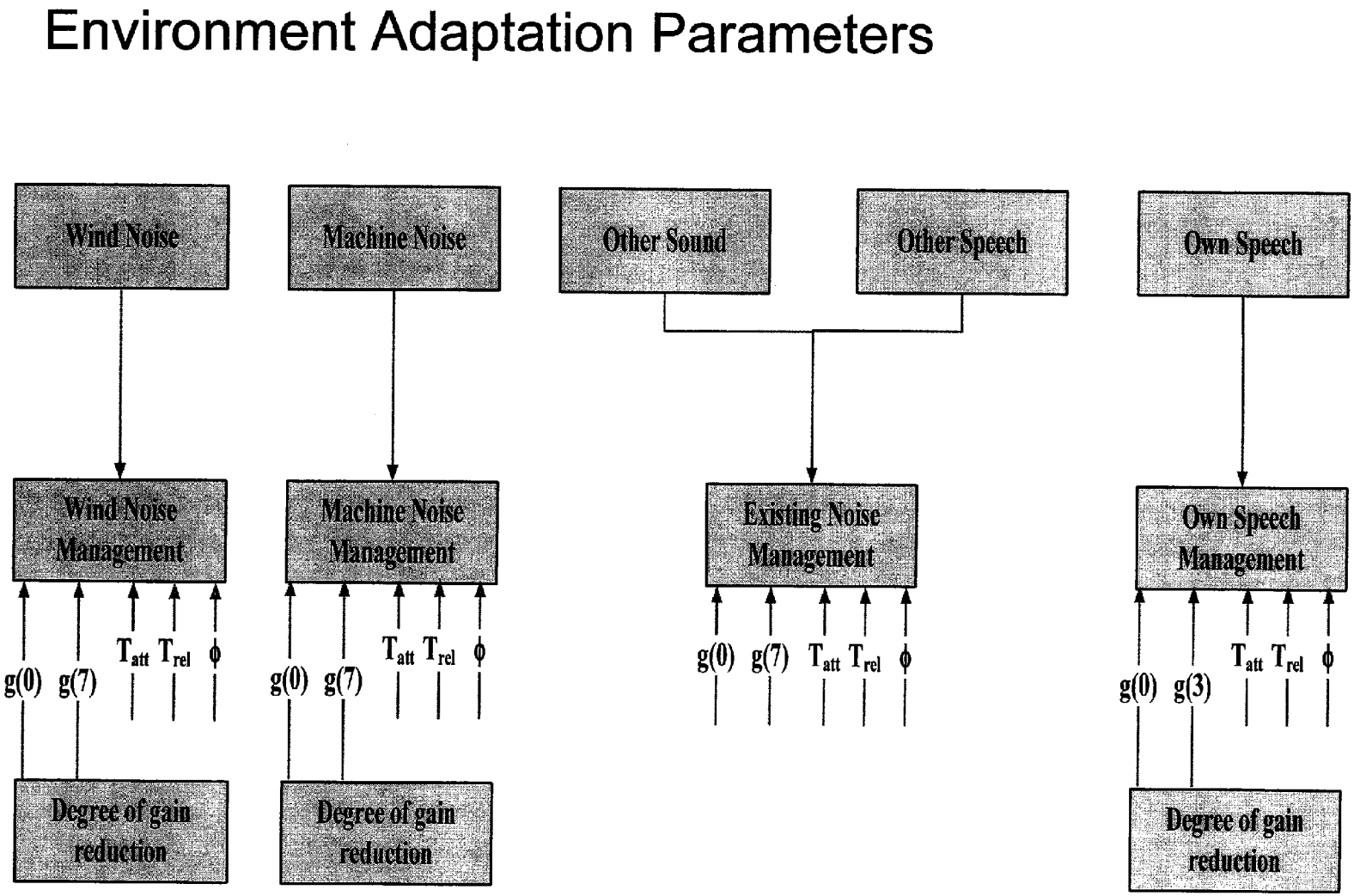
FIG. 8 shows one example of environment adaptation parameters to demonstrate various controls available according to one embodiment of the present subject matter.

FIG. 8 shows one example of environment adaptation parameters to demonstrate various controls available according to one embodiment of the present subject matter. As can be seen from the figure, the system provides in various embodiments, individual sound adaptation control. The adaptation parameters shown are only one type of example of the flexibility and programmability of the present subject matter. One advantage of frequency domain processing is that individual subband gain control is straightforward. If larger frequency ranges are desired, subbands can be grouped to form a "channel." Thus, frequency domain processing lends some benefits for algorithms focusing on particular frequency ranges. Thus, in the example of FIG. 8, eight gain control parameters control the gain in eight independent channels (groupings of subbands) for the wind noise, machine noise, other sound and other speech sound classes. The number of parameters can be varied as desired, as demonstrated by the use of fewer gain control parameters for "own speech." There are also parameters for attack and release and for misclassification threshold ($\phi$) that may be individually and programmably controlled per sound class. Thus, the processing options are vast and highly programmable with the present architecture.

It is further understood that the principles set forth herein can be applied to a variety of hearing assistance devices, including, but not limited to occluding and non-occluding applications. Some types of hearing assistance devices which may benefit from the principles set forth herein include, but are not limited to, behind-the-ear devices, on-the-ear devices, and in-the-ear devices, such as in-the-canal and/or completely-in-the-canal hearing assistance devices. Other applications beyond those listed herein are contemplated as well.

Conclusion

This application is intended to cover adaptations or variations of the present subject matter. It is to be understood that the above description is intended to be illustrative, and not restrictive. Thus, the scope of the present subject matter is determined by the appended claims and their legal equivalents.

What is claimed is:

1. An apparatus, comprising:

a microphone;

an analog-to-digital (A/D) converter connected to convert analog sound signals received by the microphone into time domain digital data;

a processor connected to process the time domain digital data and to produce time domain digital output, the processor including:

a frequency analysis module to convert the time domain digital data into subband digital data;

a feature extraction module to determine features of the subband data, the feature extraction module adapted to perform at least periodicity strength measurements;

an environment detection module to determine one or more sources of the subband data based on a plurality of possible sources identified by predetermined classification parameters, the plurality of possible sources including wind, machine noise, and speech, wherein the detection module is adapted to determine the sources using a classification result and a classification strength at least in part determined by periodicity strength measurements, wherein the classification strength includes a relative likelihood that one of the plurality of possible sound sources is detected;

an environment adaptation module to provide adaptations to processing using the determination of the one or more sources of the subband data;

a subband signal processing module to process the subband data using the adaptations from the environment adaptation module; and a time synthesis module to convert processed subband data into the time domain digital output, wherein the feature extraction module is adapted to generate two or more of:

periodicity strength measurements, high-to-low-frequency energy ratio, spectral slopes in various frequency regions, average spectral slope, overall spectral slope, spectral shape- related features, spectral centroid, omni signal power, directional signal power, and energy at a fundamental frequency.

2. The apparatus of claim 1, comprising:

a digital-to-analog (D/A) converter connected to receive the time domain digital output and convert it to analog signals.

3. The apparatus of claim 2, comprising:

a receiver to convert the analog signals to sound.

4. The apparatus of claim 1, wherein the environment detection module is further adapted to determine sources comprising: other noise.

5. The apparatus of claim 1, wherein the environment detection module is configured to distinguish a first speech source associated with a user of the apparatus and a second speech source.

6. The apparatus of claim 1, wherein the environment adaptation module includes parameter storage for each of the plurality of possible sources, the parameter storage comprising: a plurality of subband gain parameter storages.

7. The apparatus of claim 6, wherein the parameter storage further comprises:

an attack parameter storage; and a release parameter storage.

8. The apparatus of claim 6, wherein the parameter storage further comprises:

a misclassification threshold parameter storage.

9. The apparatus of claim 1, wherein the environment detection module comprises:

a Bayesian classifier.

10. The apparatus of claim 9, wherein the environment detection module comprises storage for one or more a priori probability variables.

11. The apparatus of claim 10, wherein the environment detection module comprises storage for training data.

12. The apparatus of claim 1, further comprising:

a second microphone; and a second A/D converter connected to convert analog sound signals received by the second microphone into additional time domain digital data, the additional time domain digital data combined with the time domain digital data provided to the processor for processing.

13. The apparatus of claim 1, wherein the processor further comprises a directivity module.

14. The apparatus of claim 1, wherein:

the environment detection module is adapted to determine sources comprising: wind, machines, speech, a first speech source associated with a user of the apparatus, and a second speech source;

the environment adaptation module includes parameter storage for each of the plurality of possible sources, the parameter storage comprising: a plurality of subband gain parameter storages, an attack parameter storage, a release parameter storage, and a misclassification threshold parameter storage; and the environment detection module comprises a Bayesian classifier, storage for one or more a priori probability variables, and storage for training data.

15. The apparatus of claim 14, comprising:

a digital-to-analog (D/A) converter connected to receive the time domain digital output and convert it to analog signals.

16. The apparatus of claim 14, comprising:

a receiver to convert the analog signals to sound.

17. The apparatus of claim 14, further comprising:

a second microphone; and a second A/D converter connected to convert analog sound signals received by the second microphone into additional time domain digital data, the additional time domain digital data combined with the time domain digital data provided to the processor for processing.

18. The apparatus of claim 17, wherein the processor further comprises a directivity module.

19. The apparatus of claim 18, comprising:

a digital-to-analog (D/A) converter connected to receive the time domain digital output and convert it to analog signals.

20. The apparatus of claim 19, comprising:

a receiver to convert the analog signals to sound.

21. A method for classifying sound environments of a hearing assistance device worn by a wearer, comprising:

converting one or more time domain analog acoustic signals into subband samples;

extracting features from the subband samples using time domain analog signal information;

detecting environmental parameters using the features to categorize one or more sound sources based on a predetermined plurality of possible sound sources, the plurality of possible sound sources including wind, machine noise, and speech, wherein detecting environmental parameters includes categorizing the sources using a classification result and a classification strength determined at least in part using a periodicity strength measurement, wherein the classification strength includes a relative likelihood that one of the plurality of possible sound sources is detected; and adapting processing of the subband samples using the one or more categorized sound sources, wherein the extracting includes generating two or more of: periodicity strength measurements, high-to-low-frequency energy ratio, spectral slopes in various frequency regions, average spectral slope, overall spectral slope, spectral shape-related features, spectral centroid, omni signal power, directional signal power, and energy at a fundamental frequency.

22. The method of claim 21, wherein the detecting includes using a Bayesian classifier to categorize the one or more sound sources.

23. The method of claim 21, wherein the predetermined plurality of possible sound sources further comprises: other noise.

24. The method of claim 21, further comprising discriminating speech of the wearer from speech of other speakers.

25. The method of claim 21, comprising applying parameters associated with the one or more categorized sound sources, the parameters comprising: a gain adjustment, an attack parameter, a release parameter, and a misclassification threshold parameter.

26. The method of claim 25, wherein the gain adjustment is stored as individual gain settings per subband.

27. The method of claim 21, comprising adjusting directionality using detected environmental parameters.

28. The method of claim 21, comprising: processing the subband samples using hearing aid algorithms.

29. The method of claim 21, further comprising:

using a Bayesian classifier to categorize the one or more sound sources;

discriminating speech of the wearer speech of other speakers;

applying parameters associated with the one or more categorized sound sources, the parameters comprising: a gain adjustment, an attack parameter, a release parameter, and a misclassification threshold parameter; and adjusting directionality using detected environmental parameters;

wherein:

the predetermined plurality of possible sound sources further comprises: wind, machines, and other sound; and the gain adjustment is stored as individual gain settings per subband.

30. The method of claim 29, comprising: processing the subband samples using hearing aid algorithms.

31. An apparatus, comprising:

a microphone;

an analog-to-digital (A/D) converter connected to convert analog sound signals received by the microphone into time domain digital data;

a processor connected to process the time domain digital data and to produce time domain digital output, the processor including:

a frequency analysis module to convert the time domain digital data into subband digital data;

feature extraction means for extracting features of the subband data;

environment detection means for determining one or more sources of the subband data based on a plurality of possible sources identified by predetermined classification parameters, the plurality of possible sources including wind, machine noise, and speech, wherein the environment detection means is adapted to determine the sources using a classification result and a classification strength determined at least in part using a periodicity strength measurement, wherein the classification strength includes a relative likelihood that one of the plurality of possible sound sources is detected;

environment adaptation means for providing adaptations to processing using the determination of the one or more sources of the subband data; and subband signal processing means for processing the subband data using the adaptations from the environment adaptation module, wherein the feature extraction means is adapted to generate two or more of: periodicity strength measurements, high-to-low-frequency energy ratio, spectral slopes in various frequency regions, average spectral slope, overall spectral slope, spectral shape-related features, spectral centroid, omni signal power, directional signal power, and energy at a fundamental frequency.

32. The apparatus of claim 31, further comprising a second microphone and second A/D converter and directivity means for adjusting receiving microphone configuration.

* * * * *

UNITED STATES PATENT AND TRADEMARK OFFICE

CERTIFICATE OF CORRECTION

PATENT NO. : 8,494,193 B2
APPLICATION NO. : 11/276793
DATED : July 23, 2013
INVENTOR(S) : Zhang et al.

It is certified that error appears in the above-identified patent and that said Letters Patent is hereby corrected as shown below:

On the title page, in column 1, under Item (75) "Inventors", line 2, delete "Bothwell" and insert --Bothell--, therefor On the title page, in column 2, under Item (56) "Other Publications", line 1, delete "U.S." and insert --"U.S.--, therefor On the title page, in column 2, under Item (56) "Other Publications", line 2, delete "2009," and insert --2009",--, therefor On title page 2, in column 1, under Item (56) "Other Publications", line 1, Delete "U.S." and insert --"U.S.--, therefor On title page 2, in column 1, under Item (56) "Other Publications", line 1, delete "2009," and insert --2009",--, therefor On title page 2, in column 1, under Item (56) "Other Publications", line 3, delete "U.S." and insert --"U.S.--, therefor On title page 2, in column 1, under Item (56) "Other Publications", line 4, delete "2009," and insert --2009",--, therefor On title page 2, in column 1, under Item (56) "Other Publications", line 7, delete "1999),273" and insert --1993), 273--, therefor On title page 2, in column 1, under Item (56) "Other Publications", line 8, delete "U.S." and insert --"U.S.--, therefor On title page 2, in column 1, under Item (56) "Other Publications", line 8, delete "2010," and insert --2010",--, therefor Signed and Sealed this
Eleventh Day of November, 2014

Michelle K. Lee

Michelle K. Lee
*Deputy Director of the United States Patent and Trademark Office*

On title page 2, in column 2, under Item (56) "Other Publications", line 1, delete "U.S." and insert --"U.S.--, therefor On title page 2, in column 2, under Item (56) "Other Publications", line 2, delete "2010," and insert --2010",--, therefor On title page 2, in column 2, under Item (56) "Other Publications", line 3, delete "U.S." and insert --"U.S.--, therefor On title page 2, in column 2, under Item (56) "Other Publications", line 4, delete "2010," and insert --2010",--, therefor On title page 2, in column 2, under Item (56) "Other Publications", line 5, delete "U.S." and insert --"U.S.--, therefor On title page 2, in column 2, under Item (56) "Other Publications", line 6, delete "2009," and insert --2009",--, therefor On title page 2, in column 2, under Item (56) "Other Publications", line 7, delete "U.S." and insert --"U.S.--, therefor On title page 2, in column 2, under Item (56) "Other Publications", line 8, delete "2010," and insert --2010",--, therefor On title page 2, in column 2, under Item (56) "Other Publications", line 9, delete "U.S." and insert --"U.S.--, therefor On title page 2, in column 2, under Item (56) "Other Publications", line 10, delete "2010," and insert --2010",--, therefor On title page 2, in column 2, under Item (56) "Other Publications", line 11, delete "U.S." and insert --"U.S.--, therefor On title page 2, in column 2, under Item (56) "Other Publications", line 12, delete "2010," and insert --2010",--, therefor On title page 2, in column 2, under Item (56) "Other Publications", line 19, delete "U.S." and insert --"U.S.--, therefor On title page 2, in column 2, under Item (56) "Other Publications", line 20, delete "2011," and insert --2011",--, therefor On title page 2, in column 2, under Item (56) "Other Publications", line 21, delete "U.S." and insert --"U.S.--, therefor On title page 2, in column 2, under Item (56) "Other Publications", line 22, delete "2011," and insert --2011",--, therefor On title page 2, in column 2, under Item (56) "Other Publications", line 23, delete "U.S." and insert --"U.S.--, therefor On title page 2, in column 2, under Item (56) "Other Publications", line 24, delete "2011," and insert --2011",--, therefor On title page 2, in column 2, under Item (56) "Other Publications", line 25, delete "U.S." and insert --"U.S.--, therefor On title page 2, in column 2, under Item (56) "Other Publications", line 26, delete "2010," and insert --2010",--, therefor On title page 2, in column 2, under Item (56) "Other Publications", line 27, delete "European" and insert --"European--, therefor On title page 2, in column 2, under Item (56) "Other Publications", line 28, delete "2007," and insert --2007",--, therefor On title page 2, in column 2, under Item (56) "Other Publications", line 29, delete "U.S." and insert --"U.S.--, therefor On title page 2, in column 2, under Item (56) "Other Publications", line 30, delete "2011," and insert --2011",--, therefor On title page 2, in column 2, under Item (56) "Other Publications", line 31, delete "U.S." and insert --"U.S.--, therefor On title page 2, in column 2, under Item (56) "Other Publications", line 32, delete "2011," and insert --2011",--, therefor On title page 2, in column 2, under Item (56) "Other Publications", line 33, delete "European" and insert --"European--, therefor On title page 2, in column 2, under Item (56) "Other Publications", line 34, delete "2011," and insert --2011",--, therefor On title page 2, in column 2, under Item (56) "Other Publications", line 35, delete "European" and insert --"European--, therefor On title page 2, in column 2, under Item (56) "Other Publications", line 36, delete "2012," and insert --2012",--, therefor On title page 2, in column 2, under Item (56) “Other Publications”, line 37, delete “U.S.” and insert --“U.S.--, therefor On title page 2, in column 2, under Item (56) “Other Publications”, line 38, delete “2012,” and insert --2012”,--, therefor